United States Patent [19]

Otsuka et al.

[11] 4,377,142

[45] Mar. 22, 1983

[54] AIR/FUEL RATIO CONTROL SYSTEM HAVING AN EVAPORATED FUEL PURGING CONTROL ARRANGEMENT

[75] Inventors: Kazuo Otsuka, Higashikurume; Shin Narasaka, Yono; Shumpei Hasegawa, Niiza, all of Japan

[73] Assignee: Honda Giken Kogyo Kabushiki Kaisha, Tokyo, Japan

[21] Appl. No.: 296,203

[22] Filed: Aug. 25, 1981

[30] Foreign Application Priority Data

Aug. 28, 1980 [JP] Japan ..... 55-119115

[51] Int. Cl.[3] ..... F02M 7/24; F02M 33/02

[52] U.S. Cl. ..... 123/440; 123/520; 123/179 G

[58] Field of Search ..... 123/519, 520, 440, 489, 123/491, 179 G

[56] References Cited

U.S. PATENT DOCUMENTS

| | | | |
|---|---|---|---|
| 3,680,318 | 8/1972 | Nakajima et al. | 123/519 |
| 4,046,118 | 9/1977 | Aono | 123/440 |
| 4,109,615 | 8/1978 | Asano | 123/440 |
| 4,291,659 | 9/1981 | Suzuki et al. | 123/440 |
| 4,308,842 | 1/1982 | Watanabe et al. | 123/520 |
| 4,318,383 | 3/1982 | Iritani et al. | 123/520 |

*Primary Examiner*—Charles J. Myhre
*Assistant Examiner*—Andrew M. Dolinar
*Attorney, Agent, or Firm*—Lyon & Lyon

[57] ABSTRACT

An air/fuel ratio control system for performing feedback control of the air/fuel ratio of an air/fuel mixture being supplied to an internal combustion engine. The air/fuel ratio control system is provided with an evaporated fuel purging control arrangement which is adapted to use an engine cooling water temperature sensor as an engine temperature sensor for control of purging of evaporated fuel from a canister to a venturi of the engine. At the same time, the above sensor is used for detection of various engine operating conditions for control of the air/fuel ratio of the mixture and adapted to produce an output continuously variable with a change in the temperature of engine coolant. The preclusion of the use of a special temperature sensor simplifies the structure of the evaporated fuel purging arrangement.

2 Claims, 4 Drawing Figures

20
37
38
36
29
34
35
40
42
41
4
47a
47b
47d
47
47c
46
43
28
27
33
39
44
44b
44a
44c
44d
45
34
1
2
5
6
4
3
3₁
8₄
3₂
30₁
7₂
30₂
7₁
32
31
48
8₁
8₂
8₃
13
18
16
17
14
15
9
10a
11a
10
25
26
11
12
21
24
23
22

AIR/FUEL RATIO CONTROL SYSTEM HAVING AN EVAPORATED FUEL PURGING CONTROL ARRANGEMENT

BACKGROUND OF THE INVENTION

This invention relates to an air/fuel ratio control system for performing feedback control of the air/fuel ratio of an air/fuel mixture being supplied to an internal combustion engine, and more particularly to such a system which has an automatic control function of temporarily suspending supply of evaporated fuel from a canister to the intake pipe of the engine at low engine temperature operation and subsequently starting the supply of evaporated fuel to the intake pipe upon completion of warming-up of the engine.

An air/fuel ratio control system for performing feedback control of the air/fuel ratio of an air/fuel mixture being supplied to an internal combustion engine having an intake pipe has already been proposed by the assignee of the present application, which comprises means for detecting the concentration of an exhaust gas ingredient emitted from the engine, fuel quantity adjusting means for producing the mixture being supplied to the engine, and an electrical circuit operatively connecting the concentration detecting means with the fuel quantity adjusting means in a manner effecting the feedback control operation to control the air/fuel ratio of the mixture to a predetermined value in response to an output signal produced by the concentration detecting means.

An internal combustion engine provided with a carburetor in general has a canister which accommodates activated charcoal or a like material in which evaporated fuel is absorbed, the evaporated fuel being supplied from the float chamber of the carburetor and a fuel tank provided in the engine. This canister has its interior communicating with a venturi of the carburetor so that the fuel absorbed therein is purged into the venturi of the carburetor due to negative pressure produced in the intake pipe of the engine during operation of the engine.

At the start of the engine at low temperature, the quantity of intake air is restricted due to closing of a choke valve arranged upstream of the venturi so that the mixture in the intake pipe is very rich. If purging of evaporated fuel from the canister to the venturi is effected on this occasion, the mixture becomes too rich, which is disadvantageous to the operation of the engine. Therefore, a conventional carburetor engine is provided with a solenoid valve arranged in a control conduit which is arranged to introduce negative pressure (absolute pressure) in the intake pipe into the canister, and a special sensor which is used solely to this end and arranged to detect a low temperature condition of the engine. The solenoid valve is actuated in response to the output of the special sensor to cause temporary suspension of the fuel purging from the canister to the venturi at low engine temperature operation (purge cut).

OBJECTS AND SUMMARY OF THE INVENTION

It is an object of the invention to provide an air/fuel ratio control system in which the above special sensor conventionally used for the exclusive use of evaporated fuel purging is replaced by a sensor which is originally intended and arranged to detect engine cooling water temperature for detection of various air/fuel ratio control conditions of the engine. Thus, the above engine cooling water temperature sensor is also arranged to serve as a sensor for detecting a low engine temperature condition for control of purging of fuel from the canister to the venturi, which can lead to simplification of the structure of the system, a reduction in the manufacturing cost and facilitation of the maintenance of the system.

It is a further object of the invention to provide an air/fuel ratio control system which is capable of automatically suspending and starting the fuel purging in response to the output of the above sensor, with high reliability and accuracy.

According to the invention, there is provided an air/fuel ratio control system for performing feedback control of the air/fuel ratio of an air/fuel mixture being supplied to an internal combustion engine, which includes means for detecting the concentration of an exhaust gas ingredient emitted from the engine, fuel quantity adjusting means for producing the mixture being supplied to the engine, and an electrical circuit operatively connecting the concentration detecting means with the fuel quantity adjusting means in a manner effecting feedback control operation to control the air/fuel ratio of the mixture to a predetermined value in response to an output signal produced by the concentration detecting means. The system is characterized by further comprising in combination: a canister in which evaporated fuel is absorbed; a purge conduit connecting the canister to the intake pipe of the engine for allowing the absorbed fuel in the canister to be purged into the intake pipe; a purge control valve having negative pressure-actuatable means and arranged across the purge conduit; a control conduit connecting the negative pressure-actuatable means of the purge control valve to the intake pipe; a solenoid valve arranged to selectively close and open the control conduit; means for driving the solenoid valve; a temperature sensor responsive to a change in the temperature of engine coolant to produce an output continuously variable with said change; and circuit means provided within the electrical circuit and operable to detect operating condition of the engine. The engine operating condition detecting circuit means is connected to the above temperature sensor to be supplied with the output of the sensor. The electrical circuit is operable to carry out control of the air/fuel ratio of the mixture in response to the output of the temperature sensor supplied to the circuit means. The circuit means is connected to the above solenoid valve driving means and adapted to supply a control signal thereto when the output of the temperature sensor exceeds a predetermined value. The solenoid valve driving means is operable upon this control signal to actuate the solenoid valve to cause the negative pressure-actuatable means of the purge control valve to communicate with atmospheric air.

The above and other objects, features and advantages of the invention will be more apparent from the ensuing detailed description taken in connection with the accompanying drawings in which:

DETAILED DESCRIPTION

The air/fuel ratio control system according to the invention will now be described in detail with reference to the accompanying drawings wherein an embodiment of the invention is illustrated.

Figure 1:
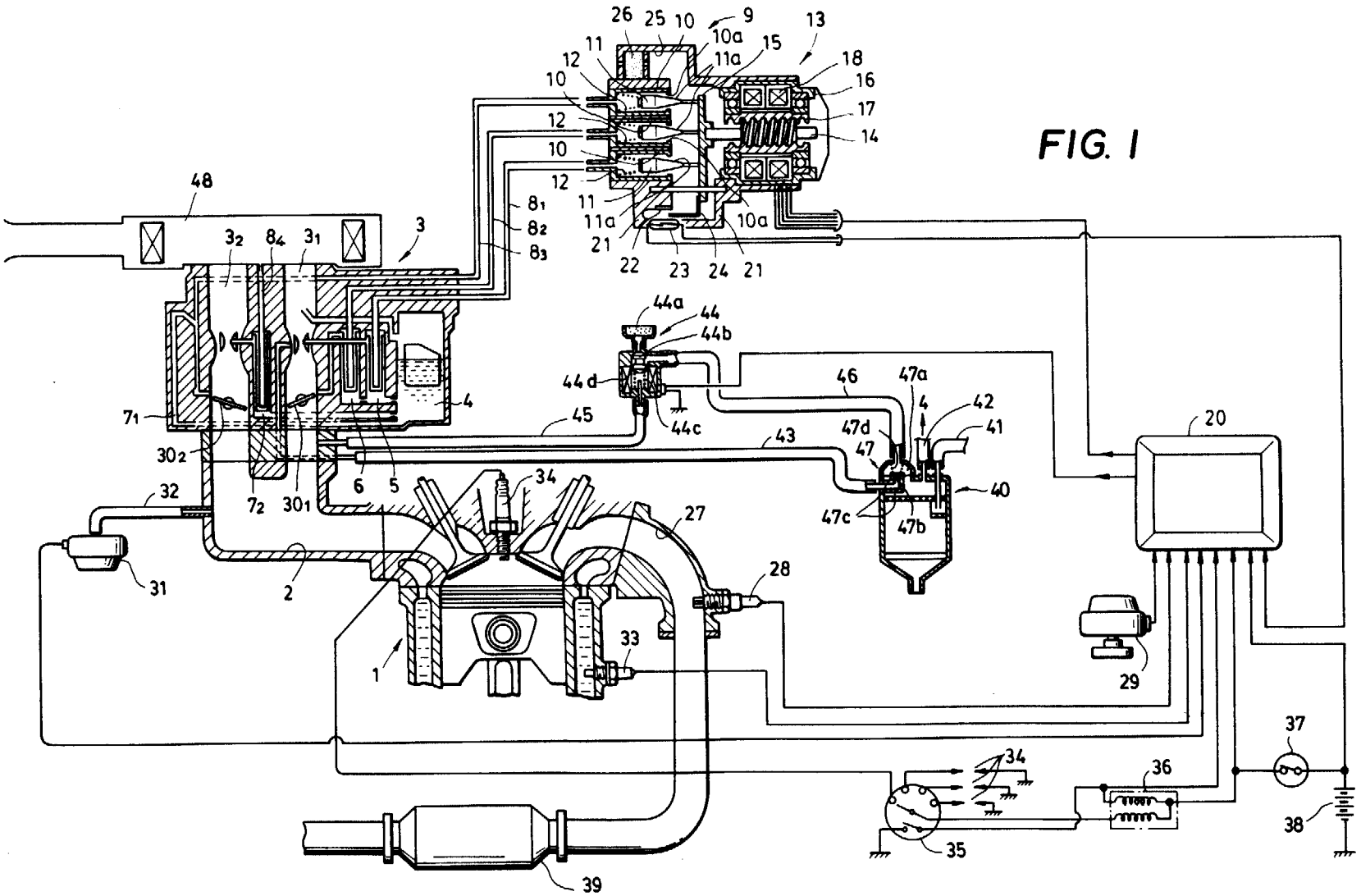
FIG. 1 is a diagrammatic view illustrating an air/fuel ratio control system according to the invention.

Referring now to FIG. 1, there is illustrated the whole system of the invention. Reference numeral 1 designates an internal combustion engine. Connected to the engine 1 is an intake manifold 2 which is provided with a carburetor generally designated by the numeral 3. The carburetor 3 has fuel passages 5, 6 which communicate a float chamber 4 with the primary bore $3_1$ of the carburetor 3. These fuel passages 5, 6 are connected to an air/fuel ratio control valve generally designated by the numeral 9, via air bleed passages $8_1$, $8_2$. The carburetor 3 also has fuel passages $7_1$, $7_2$ communicating the float chamber 4 with the secondary bore $3_2$ of the carburetor 3. The fuel passage $7_1$, on one hand, is connected to the above air/fuel ratio control valve 9 via an air passage $8_3$ and, on the other hand, opens in the secondary bore at a location slightly upstream of a throttle valve $30_2$ in the secondary bore $3_2$. The fuel passage $7_2$ communicates with the interior of an air cleaner 48 via an air passage $8_4$ having a fixed orifice. The control valve 9 is comprisd of three flow rate control valves, each of which is formed of a cylinder 10, a valve body 11 displaceably inserted into the cylinder 10, and a coil spring 12 interposed between the cylinder 10 and the valve body 11 for urging the valve body 11 in a predetermined direction. Each valve body 11 is tapered along its end portion 11*a* remote from the coil spring 12 so that the effective opening area of the opening 10*a* of each cylinder 10, in which the tapered portion 11*a* of the valve body is inserted, varies as the valve body 11 is moved. Each valve body 11 is disposed in urging contact with a connection plate 15 coupled to a worm element 14 which is axially movable but not rotatable about its own axis. The worm element 14 is in threaded engagement with the rotor 17 of a pulse motor 13 which is arranged about the element 14 and rotatably supported by radial bearings 16. Arranged about the rotor 17 is a solenoid 18 which is electrically connected to an electronic control unit (hereinafter called "ECU") 20. The solenoid 18 is energized by driving pulses supplied from ECU 20 to cause rotation of the rotor 17 which in turn causes movement of the worm element 14 threadedly engaging the rotor 17 in the leftward and rightward directions as viewed in FIG. 1. Accordingly, the connection plate 15 coupled to the worm element 14 is moved leftward and rightward in unison with the movement of the worm element 14.

The pulse motor 13 has its stationary housing 21 provided with a permanent magnet 22 and a reed switch 23 arranged opposite to each other. The plate 15 is provided at its peripheral edge with a magnetic shielding plate 24 formed of a magnetic material which is interposed between the permanent magnet 22 and the reed switch 23 for movement into and out of the gap between the two members 22, 23. The magnetic shielding plate 24 is displaced in the leftward and rightward directions in unison with displacement of the plate 15 in the corresponding directions. The reed switch 23 turns on or off in response to the displacement of the plate 24. That is, when the valve body 11 of the air/fuel ratio control valve 9 passes a reference position which is determined by the positions of the permanent magnet 22, reed switch 23 and magnetic shielding plate 24, the reed switch 23 turns on or off depending upon the moving direction of the valve body 11, to supply a corresponding binary output signal to ECU 20.

Incidentally, the pulse motor housing 21 is formed with an air intake 25 communicating with the atmosphere. Air is introduced through a filter 26 mounted in the air intake 25, into each flow rate control valve in the housing 21.

On the other hand, an $O_2$ sensor 28, which is made of stabilized zirconium oxide or the like, is mounted in the peripheral wall of the exhaust manifold 27 of the engine 1 in a manner partly projecting in the manifold 27. The sensor 28 is electrically connected to ECU 20 to supply its output signal thereto. An atmospheric pressure sensor 29 is arranged to detect the ambient atmospheric pressure surrounding the vehicle, not shown, in which the engine 1 is installed, and also electrically connected to ECU 20 to supply its output signal thereto.

A thermistor 33 is inserted in the peripheral wall of an engine cylinder, the interior of which is filled with engine cooling water, to detect the temperature of the cooling water as the engine temperature. The thermistor 33 is also electrically connected to ECU 20 to supply its output signal thereto. This thermistor 33 has a negative temperature coefficient, that is, has its internal resistance continuously decreasing with a rise in the temperature. The electrical circuit provided within ECU 20 converts a continuous change in the internal resistance of the thermistor 33 which is a function of a change in the engine cooling water temperature, into a corresponding continuous change in electric voltage, to thus detect the temperature of the engine cooling water, as described later. The thermistor 33 is used for determination of a condition of initiation of the air/fuel ratio of the mixture, a condition of temporary suspension of fuel purging from a canister, hereinafter referred to, to a venturi of the carburetor 3 at low engine temperature operation, a condition of closure of an exhaust recirculation valve, not shown, at low engine load operation and at low engine temperature operation, etc. To this end, it is adapted to produce an output continuously varying with a change in the temperature of the engine ranging over a wide range so that it can detect a plurality of different predetermined engine temperature values for effecting control of the air/fuel ratio under various engine conditions, hereinafter described.

Reference numeral 40 denotes a canister which has its interior communicating with a fuel tank, not shown, and the upper portion of the float chamber 4 of the carburetor 3 by way of conduits 41, 42, respectively, to be supplied with evaporated fuel from the fuel tank and the float chamber 4. Connected to the canister 40 are a purge conduit 43 which opens at its one end in the primary venturi of the carburetor 3, and a control conduit 46 which communicates with another control conduit 45 opening in the primary bore $3_1$ at a zone downstream of the throttle valve $30_1$, by way of a solenoid valve (purge cut valve) 44. The canister 40 has a built-in valve 47 of the negative pressure responsive type which acts as a purge control valve and is formed of a diaphragm 47*b* which defines, in cooperation with the canister casing, a pressure chamber 47*a* communicating with the control conduit 46, a valve seat 47*c* formed integrally on the peripheral wall of the canister 40 and having a bore communicating with the purge conduit 43, and a spring 47*d* arranged to urge the diaphragm 47*b* against the valve seat 47*c*. On the other hand, the solenoid valve 44 is formed of an air intake 44*a* provided with a filter and communicating with the atmosphere, a valve body 44*b* displaceable to interrupt the communication between the air intake 44*a* and the control conduit 46, a spring 44*c* disposed to urge the valve body 44*b* in its closing direction, and a solenoid 44*d* disposed to be energized by a control signal supplied from ECU 20. With this arrangement, when the solenoid valve 44 is inoperative, negative pressure produced in the intake manifold 2 at a zone downstream of the throttle valve $30_1$ during operation of the engine is introduced into the pressure chamber 47*a* through the control conduits 45, 46 to cause the diaphragm 47*b* to be displaced against the force of the spring 47*d* in the valve opening direction. Thus, the valve 47 is opened to allow fuel vapor absorbed in the canister 40 to be supplied or purged to the primary venturi through the conduit 43.

The solenoid valve 44 is operated at the start of the engine to allow the control conduit 46 to communicate with the atmosphere through the air intake 44*a* to cause the valve 47 to close so that supply of fuel vapor absorbed in the canister 40 to the primary venturi or purging is temporarily suspended (purge cut). This operation is necessary by reason that at the start of the engine the amount of suction air is limited due to closing of the choke valve, not shown, located upstream of the venturi to render the mixture in the intake manifold 2 sufficiently rich. Supply of fuel vapor in the canister 40 to the intake manifold 2 on this occasion would render the mixture in the manifold 2 too rich. Therefore, at the start of the engine the solenoid valve 44 is operated to cause temporary suspension of the supply of the fuel vapor from the canister 40 to the manifold 2. The supply of the fuel vapor from the canister 40 to the intake manifold 2 is started after the choke valve has been opened following the start of the engine and simultaneously the engine temperature has exceeded a predetermined value due to warming-up of the engine following the start of the engine. The engine temperature can be represented by the temperature of engine cooling water which, in the embodiment shown in FIG. 1, is detected by the thermistor 33 inserted in the peripheral wall of a cylinder of the engine the interior of which wall is filled with cooling water, as previously mentioned. The detected value signal produced by the thermistor 33 is supplied to ECU 20. ECU 20 then compares the value of the detected value signal with a predetermined value, e.g., 70° C., stored therein. When the former exceeds the latter, ECU 20 interrupts the energization of the solenoid valve 44 which has been continued from the start of the engine, to cause communication of the conduit 46 with the control conduit 45 to initiate supply of the fuel vapor absorbed in the canister 40 to the venturi through the valve 47 and the purge conduit 43.

In FIG. 1, reference numeral 39 designates a three-way catalyst for purifying CO, HC and NOx present in the exhaust gases, 31 a pressure sensor arranged to detect suction pressure in the intake manifold 2 at a zone downstream of the throttle valves $30_1$, $30_2$, through a conduit 32, and electrically connected to ECU 20 to supply its output thereto, 34 an ignition plug, 35 a distributor, 36 an ignition coil, 37 an ignition switch, and 38 a battery. The distributor 35 has a drive shaft, not shown, which is arranged for rotation at speeds proportional to the rotational speed of the engine, and accordingly pulses are produced in the ignition coil 36, which correspond in frequency to switching of the contact points or the output of a contactless pickup alternatively provided, the contact points or the contactless pickup being arranged for operation in synchronism with the rotation of the above drive shaft. The above pulses produced in the ignition coil 36 are supplied to ECU 20. Thus, in the illustrated embodiment, the distributor 35 and the ignition coil 36 cooperate to act as an engine rpm sensor.

Details of the air/fuel ratio control which can be performed by the air/fuel ratio control system according to the invention will now be described by reference to FIG. 1 which has been referred to hereinabove.

Initialization

Referring first to the initialization, when the ignition switch 37 in FIG. 1 is set on, ECU 20 is initialized to detect the reference position of the actuator or pulse motor 13 by means of the read switch 23 and hence drive the pulse motor 13 to set it to its best position (a preset position) for starting the engine, that is, set the initial air/fuel ratio to a predetermind proper value. The above preset position of the pulse motor 13 is hereinafter called "$PS_{CR}$". This setting of the initial air/fuel ratio is made on condition that the engine rpm Ne is lower than a predetermined value $N_{CR}$ (e.g., 400 rpm) and the engine is in a condition before firing. The predetermined value $N_{CR}$ is set at a value higher than the cranking rpm and lower than the idling rpm.

The above reference position of the pulse motor 13 is detected as the position at which the reed switch 23 turns on or off, as previously mentioned with reference to FIG. 1.

Then, ECU 20 monitors the condition of activation of the $O_2$ sensor 28 and the coolant temperature Tw detected by the thermistor 33 to determine whether or not the engine is in a condition for initiation of the air/fuel ratio control. For accurate air/fuel ratio feedback control, it is a requisite that the $O_2$ sensor 28 is fully activated and the engine is in a warmed-up condition. The $O_2$ sensor, which is made of stabilized zirconium dioxide or the like, has a characteristic that its internal resistance decreases as its temperature increases. If the $O_2$ sensor is supplied with electric current through a resistance having a suitable resistance value from a constant-voltage regulated power supply provided within ECU 20, the electrical potential or output voltage of the sensor initially shows a value close to the power supply voltage (e.g., 5 volts) when the sensor is not activated, and then, its electrical potential lowers with the increase of its temperature. Therefore, according to the invention, the air/fuel ratio feedback control is not initiated until after the conditions have been fulfilled that the sensor produces an activation signal when its output voltage lowers down to a predetermined voltage Vx (e.g., 0.5 volt) a timer finishes counting for a predetermined period of time $t_x$ (e.g., 1 minute) starting from the occurrence of the above activation signal, and the coolant temperature Tw increases up to a predetermined value Twx at which the automatic choke is opened to an opening for enabling the air/fuel ratio feedback control.

During the above stage of the detection of activation of the $O_2$ sensor and the coolant temperature Tw, the pulse motor 13 is held at its predetermined position $PS_{CR}$. The pulse motor 13 is driven to appropriate positions in response to the operating condition of the engine after initiation of the air/fuel ratio control, as hereinlater described.

Basic Air/Fuel Ratio Control

Following the initialization, the program proceeds to the basic air/fuel ratio control.

ECU 20 is responsive to various detected value signals representing the output voltage of the $O_2$ sensor 28, the absolute pressure in the intake manifold 2 detected by the pressure sensor 31, the engine rpm Ne detected by the rpm sensor 35, 36, and the atmospheric pressure $P_A$ detected by the atmospheric pressure sensor 29, to drive the pulse motor 13 as a function of these signals to control the air/fuel ratio. More specifically, the basic air/fuel ratio control comprises open loop control which is carried out at wide-open-throttle, at engine idle, and at engine deceleration, and closed loop control which is carried out at engine partial load. All the control is initiated after completion of the warming-up of the engine.

First, the condition of open loop control at wide-open-throttle is met when the differential pressure $P_A$-$P_B$ (gauge pressure) between the absolute pressure $P_B$ detected by the pressure sensor 31 and the atmospheric pressure $P_A$ (absolute pressure) detected by the atmospheric pressure sensor 29 is lower than a predetermined value $\Delta P_{WOT}$. ECU 20 compares the difference in value between the output signals of the sensors 29, 31 with the predetermined value $\Delta P_{WOT}$ stored therein, and when the relationship of $P_A$-$P_B < \Delta P_{WOT}$ stands, drives the pulse motor 13 to a predetermined position (preset position) $PS_{WOT}$ and holds it there, which is a position best appropriate for the engine emissions to be obtained at the time of termination of the wide-open-throttle open loop control. At wide-open-throttle, a known economizer, not shown, or the like is actuated to supply a rich or small air/fuel ratio mixture to the engine.

The condition of open loop control at engine idle is met when the engine rpm Ne is lower than a predetermined idle rpm $N_{IDL}$ (e.g., 1,000 rpm). ECU 20 compares the output signal value Ne of the rpm sensor 35, 36 with the predetermined rpm $N_{IDL}$ stored therein, and when the relationship of $Ne < N_{IDL}$ stands, drives the pulse motor 13 to a predetermined idle position (preset position) $PS_{IDL}$ which is best suitable for the engine emissions and holds it there.

The above predetermined idle rpm $N_{IDL}$ has a value slightly higher than the actual idle rpm to which the engine is adjusted.

The condition of open loop control at engine deceleration is fulfilled when the absolute pressure $P_B$ in the intake manifold is lower than a predetermined value $PB_{DEC}$. ECU 20 compares the output signal value $P_B$ of the pressure sensor 31 with the predetermined value $PB_{DEC}$ stored therein, and when the relationship of $P_B < PB_{DEC}$ stands, drives the pulse motor 13 to a predetermined deceleration position (preset position) $PS_{DEC}$ best suitable for the engine emissions and holds it there.

The ground for this condition of open loop control at engine deceleration lies in that when the absolute pressure $P_B$ in the intake manifold drops below the predetermined value, unburned HC is produced at an increased rate in the exhaust gases, to make it impossible to carry out the air/fuel ratio feedback control based upon the detected value signal of the $O_2$ sensor with accuracy, thus failing to control the air/fuel ratio to a theoretical value. Therefore, according to the invention, the open loop control is employed, as noted above, when the absolute pressure $P_B$ in the intake manifold detected by the pressure sensor 31 is smaller than the predetermined value $PB_{DEC}$, where the pulse motor is set to the predetermined position $PS_{DEC}$ best suitable for the engine emissions obtained at the time of termination of the deceleration open loop control.

During operations of the above-mentioned open loop control at wide-open-throttle, at engine idle, at engine deceleration, the respective predetermined positions $PS_{WOT}$, $PS_{IDL}$, $PS_{DEC}$ for the pulse motor 13 are compensated for atmospheric pressure $P_A$, as hereinlater described.

On the other hand, the condition of closed loop control at engine partial load is met when the engine is in an operating condition other than the above-mentioned open loop control conditions. During the closed loop control, ECU 20 performs selectively feedback control based upon proportional term correction (hereinafter called "P term control") and feedback control based upon integral term correction (hereinafter called "I term control"), in response to the engine rpm Ne detected by the engine rpm sensor 35, 36 and the output signal of the $O_2$ sensor 28. To be concrete, the integral term correction is used when the output voltage of the $O_2$ sensor 28 varies only at the higher level side or only at the lower level side with respect to a reference voltage Vref, wherein the position of the pulse motor 13 is corrected by an integral value obtained by integrating the value of a binary signal which changes in dependence on whether the output voltage of the $O_2$ sensor is at the higher level or at the lower level with respect to the predetermined reference voltage Vref, to thereby achieve stable and accurate position control of the pulse motor 13. On the other hand, when the output signal of the $O_2$ sensor changes from the higher level to the lower level or vice versa, the proportional term correction is carried out wherein the position of the pulse motor 13 is corrected by a value directly proportional to a change in the output voltage of the $O_2$ sensor to thereby achieve air/fuel ratio control in a manner more prompt and more efficient than the integral term correction.

As noted above, according to the above I term control, the pulse motor position is varied by an integral value by integrating the value of a binary signal corresponding to the change of the output voltage of the $O_2$ sensor. According to this I term control, the number of steps by which the pulse motor is to be displaced per second differs depending upon the speed at which the engine is then operating. That is, in a low engine rpm range, the number of steps by which the pulse motor is to be displaced is small. With an increase in the engine rpm, the above number of steps increases so that it is large in a high engine rpm range.

Whilst, according to the P term control which, as noted above, is used when there is a change in the output voltage of the $O_2$ sensor from the higher level to the lower one or vice versa with respect to the reference voltage Vref, the number of steps by which the pulse motor is to be displaced per second is set at a single predetermined value (e.g., 6 steps), irrespective of the engine rpm.

The air/fuel ratio control at engine accelerations (i.e., off-idle acceleration) is carried out when the engine rpm Ne exceeds the aforementioned predetermined idle rpm $N_{IDL}$ during the course of the engine speed increasing from a low rpm range to a high rpm range, that is, when the engine speed changes from a relationship $Ne < N_{IDL}$ to one $Ne \geqq N_{IDL}$. On this occasion, ECU 20 rapidly moves the pulse motor 13 to a predetermined acceleration position (preset position) $PS_{ACC}$, and thereafter initiates the aforementioned air/fuel ratio feedback control. This predetermined position $PS_{ACC}$ is compensated for atmospheric pressure $P_A$, too, as hereinlater described.

The above-mentioned predetermined position $PS_{ACC}$ is set at a position where the amount of detrimental ingredients in the exhaust gases is small. Therefore, particularly at the so-called "standing start", i.e., acceleration from a vehicle-stopping position, setting the pulse motor position to the predetermined position $PS_{ACC}$ is advantageous to anti-exhaust measures, as well as to achievement of accurate air/fuel ratio feedback control to be done following the acceleration. By setting the pulse motor position to the preset value $PS_{ACC}$ at the standing start of the vehicle, it is possible to reduce the amount of detrimental ingredients in the exhaust gases to be emitted from the engine on such occasion. Further, this setting of the pulse motor position determines the initial air/fuel ratio to be obtained at the start of the air/fuel ratio feedback control operation immediately following the standing start, which enables achieving an air/fuel ratio best appropriate for the emission characteristics and driveability of the engine at the start of the subsequent air/fuel ratio feedback control operation. Particularly, this results in a large reduction in the total amount of detrimental gas ingredients in the exhaust gases emitted from the engine from the standing start to the immediately-following air/fuel ratio feedback control operation, thus being advantageous to the anti-pollution measures.

In transition from the above-mentioned various open loop control to the closed loop control at engine partial load or vice versa, changeover between open loop mode and closed loop mode is effected in the following manner: First, in changing from closed loop mode to open loop mode, ECU 20 moves the pulse motor 13 to an atmospheric pressure-compensated predetermined position $PSi(P_A)$ in a manner referred to later, irrespective of the position at which the pulse motor was located immediately before entering the open loop control. This predetermined position $PSi(P_A)$ includes preset positions $PS_{CR}$, $PS_{WOT}$, $PS_{IDL}$, $PS_{DEC}$ and $PS_{ACC}$, each of which is corrected in response to actual atmospheric pressure as hereinlater referred to. Various open loop control operations can be promptly done, simply by setting the pulse motor to the above-mentioned respective predetermined positions.

On the other hand, in changing from open loop mode to closed loop mode, ECU 20 commands the pulse motor 13 to initiate air/fuel ratio feedback control with I term correction. That is, there can be a difference in timing between the change of the output signal level of the $O_2$ sensor from the high level to the low level or vice versa and the change from the open loop mode to the closed loop mode. In such an event, the deviation of the pulse motor position from the proper position upon entering the closed loop mode, which is due to such timing difference, is much smaller in the case of initiating air/fuel ratio control with I term correction than that in the case of initiating it with P term correction, to make it possible to resume early accurate air/fuel ratio control and accordingly ensure highly stable engine emissions.

To obtain optimum exhaust emission characteristics irrespective of changes in the actual atmospheric pressure during open loop air/fuel ratio control or at the time of shifting from open loop mode to closed loop mode, the position of the pulse motor 13 needs to be compensated for atmospheric pressure. According to the invention, the above-mentioned predetermined or preset positions $PS_{CR}$, $PS_{WOT}$, $PS_{IDL}$, $PS_{DEC}$, $PS_{ACC}$ at which the pulse motor 13 is to be held during the respective open loop control operations are corrected in a linear manner as a function of changes in the atmospheric pressure $P_A$, using the following equation:

$$PSi(P_A) = PSi + (760 - P_A) \times Ci$$

where i represents any one of CR, WOT, IDL, DEC and ACC, accordingly PSi represents any one of $PS_{CR}$, $PS_{WOT}$, $PS_{IDL}$, $PS_{DEC}$ and $PS_{ACC}$ at 1 atmospheric pressure (=760 mmHg), and Ci a correction coefficient, representing any one of $C_{CR}$, $C_{WOT}$, $C_{IDL}$, $C_{DEC}$ and $C_{ACC}$. The values of PSi and Ci are previously stored in ECU 20.

ECU 20 applies to the above equation the coefficients PSi, Ci which are determined at proper different values according to the kinds of open loop control to be carried out, to calculate by the above equation the position $PSi(P_A)$ for the pulse motor 13 to be set at a required kind of open loop control and moves the pulse motor 13 to the calculated position $PSi(P_A)$.

By correcting the air/fuel ratio during open loop control in response to the actual atmospheric pressure in the above-mentioned manner, it is possible to obtain not only conventionally known effects such as best driveability and prevention of burning of the ignition plug in an engine cylinder, but also optimum emission characteristics by setting the value of Ci at a suitable value, since the pulse motor position held during open loop control forms an initial position upon entering subsequent closed loop control.

The position of the pulse motor 13 which is used as the actuator for the air/fuel ratio control valve 9 is monitored by a position counter provided within ECU 20. However, there can occur a disagreement between the counted value of the position counter and the actual position of the pulse motor due to skipping or racing of the pulse motor. In such an event, ECU 20 operates on the counted value of the position counter as if it were the actual position of the pulse motor 13. However, this can impede proper setting of the air/fuel ratio during open loop control where the actual position of the pulse motor 13 must be accurately recognized by ECU 20.

In view of the above disadvantage, according to the air/fuel ratio control system of the invention, in addition to detection of the initial position of the pulse motor 13 by regarding as the reference position (e.g., 50th step) the position of the pulse motor at which the reed switch 23 turns on or off when the pulse motor is driven, which was previously noted with reference to the initialization, the position counter has its counted value replaced by the number of steps corresponding to the reference position (e.g., 50 steps) stored in ECU 20 upon the pulse motor 13 passing the switching point of the reed switch 23, to thus ensure high reliability of subsequent air/fuel ratio control.

Control of Purging of Evaporated Fuel

The description previously given with reference to FIG. 1 already referred to the temporary suspension of purging of fuel from the canister 40 to the venturi of the carburetor 3. The condition of temporary suspension is fulfilled when the engine cooling water temperature Tw is lower than a predetermined value Twp. More specifically, until the engine temperature rises up to a predetermined value due to warming-up operation of the engine following the start of the engine, ECU 20 keeps the solenoid valve 44 energized, allowing atmospheric pressure to be introduced into the pressure chamber 47*a* of the valve 47 at the upper portion of the canister 40 so that the valve 47 is kept closed to suspend the supply or purging of absorbed fuel vapor from the canister 40 to the venturi. When the engine temperature rises above the predetermined value, ECU 20 causes the solenoid valve 44 to be deenergized to start purging of absorbed fuel vapor from the canister 40 to the venturi.

Figure 2:
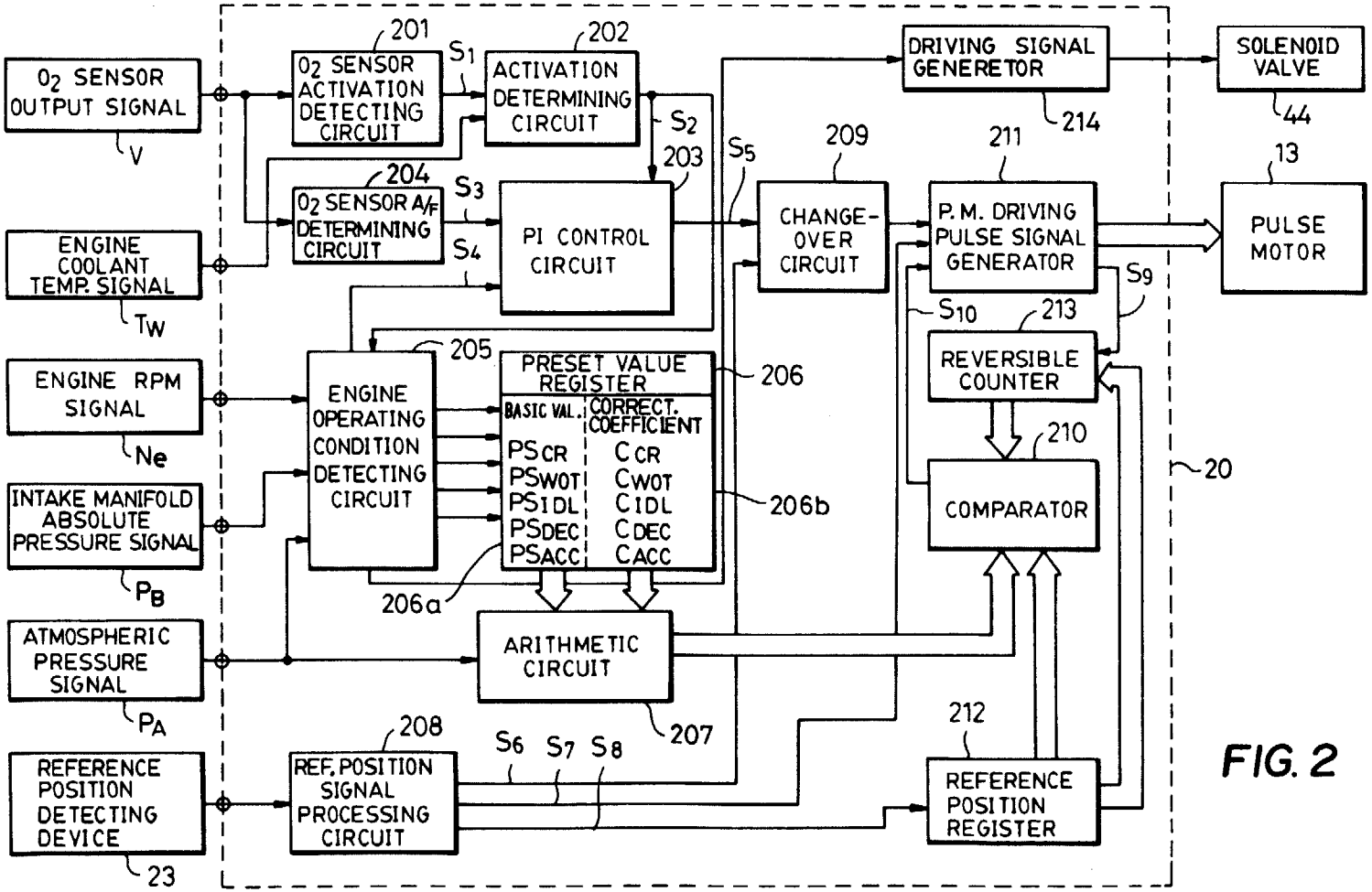
FIG. 2 is a block diagram illustrating an electrical circuit provided within the electronic control unit in FIG. 1.

FIG. 2 is a block diagram illustrating the interior construction of ECU 20 used in the air/fuel ratio control system having the above-mentioned functions according to the invention. In ECU 20, reference numeral 201 designates a circuit for detecting the activation of the $O_2$ sensor 28 in FIG. 1, which is supplied at its input with an output signal V from the $O_2$ sensor. Upon passage of the predetermined period of time $t_x$ after the voltage of the above output signal V has dropped below the predetermined value Vx, the above circuit 201 supplies an activation signal $S_1$ to an activation determining circuit 202. This activation determining circuit 202 is also supplied at its input with an engine coolant temperature signal Tw from the thermistor 33 in FIG. 1. When supplied with both the above activation signal $S_1$ and the coolant temperature signal Tw indicative of a value exceeding the predetermined value Twx, the activation determining circuit 202 supplies an air/fuel ratio control initiation signal $S_2$ to a PI control circuit 203 to render same ready to operate. Reference numeral 204 represents an air/fuel ratio determining circuit which determines the value of air/fuel ratio of engine exhaust gases, depending upon whether or not the output voltage of the $O_2$ sensor is larger than the predetermined value Vref, to supply a binary signal $S_3$ indicative of the value of air/fuel ratio thus obtained, to the PI control circuit 203. On the other hand, an engine condition detecting circuit 205 is provided in ECU 20, which is supplied with an engine rpm signal Ne from the engine rpm sensor 35, 36, an absolute pressure signal $P_B$ from the pressure sensor 31, an atmospheric pressure signal $P_A$ from the atmospheric pressure sensor 29, all the sensors being shown in FIG. 1, and the above control initiation signal $S_2$ from the activation determining circuit 202 in FIG. 2, respectively. The circuit 205 supplies a control signal $S_4$ indicative of a value corresponding to the values of the above input signals to the PI control circuit 203. The PI control circuit 203 accordingly supplies to a change-over circuit 209 to be referred to later a pulse motor control signal $S_5$ having a value corresponding to the air/fuel ratio signal $S_3$ from the air/fuel ratio determining circuit 204 and a signal component corresponding to the engine rpm Ne in the control signal $S_4$ supplied from the engine condition detecting circuit 205.

Also, the engine condition detecting circuit 205 supplies to the PI control circuit 203 the above control signal $S_4$ containing a signal component corresponding to the engine rpm Ne, the absolute pressure $P_B$ in the intake manifold, atmospheric pressure $P_A$ and the value of air/fuel ratio control initiation signal $S_2$. When supplied with the above signal component from the engine condition detecting circuit 205, the PI control circuit 203 interrupts its own operation. Upon interruption of the supply of the above signal component to the control circuit 203, a pulse signal $S_5$ is outputted from the circuit 203 to the change-over circuit 209, which signal starts air/fuel ratio control with integral term correction.

A preset value register 206 is provided in ECU 20, which is formed of a basic value register section 206*a* in which are stored the basic values of preset values $PS_{CR}$, $PS_{WOT}$, $PS_{IDL}$, $PS_{DEC}$ and $PS_{ACC}$ for the pulse motor position, applicable to various engine conditions, and a correcting coefficient register section 206*b* in which are stored atmospheric pressure correcting coefficients $C_{CR}$, $C_{WOT}$, $C_{IDL}$, $C_{DEC}$ and $C_{ACC}$ for these basic values. The engine condition detecting circuit 205 detects the operating condition of the engine based upon the activation of the $O_2$ sensor and the values of engine rpm Ne, intake manifold absolute pressure $P_B$ and atmospheric pressure $P_A$ to read from the register 206 the basic value of a preset value corresponding to the detected operating condition of the engine and its corresponding correcting coefficient and apply same to an arithmetic circuit 207. The arithmetic circuit 207 performs arithmetic operation responsive to the value of the atmospheric pressure signal $P_A$, using the equation $PSi(P_A)=PSi+(760-P_A)\times Ci$. The resulting preset value is applied to a comparator 210.

The engine operating condition detecting circuit 205 is also connected to the solenoid valve 44 by way of a solenoid valve driving signal generator 214 which will be referred to later.

On the other hand, a reference position signal processing circuit 208 is provided in ECU 20, which is responsive to the output signal of the reference position detecting device (reed switch) 23, indicative of the switching of same to produce a binary signal $S_6$ having a certain level from the start of the engine until it is detected that the pulse motor reaches the reference position. This binary signal $S_6$ is supplied to the change-over circuit 209 which in turn keeps the control signal $S_5$ from being transmitted from the PI control circuit 203 to a pulse motor driving signal generator 211 as long as it is supplied with this binary signal $S_6$, thus avoiding the interference of the operation of setting the pulse motor to the initial position with the operation of P-term/I-term control. The reference position signal processing circuit 208 also produces a pulse signal $S_7$ in response to the output signal of the reference position detecting device 23, which signal causes the pulse motor 13 to be driven in the step-increasing direction or in the step-decreasing direction so as to detect the reference position of the pulse motor 13. This signal $S_7$ is supplied directly to the pulse motor driving signal generator 211 to cause same to drive the pulse motor 13 until the reference position is detected. The reference position signal processing circuit 208 produces another pulse signal $S_8$ each time the reference position is detected. This pulse signal $S_8$ is supplied to a reference position register 212 in which the value of the reference position (e.g., 50 steps) is stored. This register 212 is responsive to the above signal $S_8$ to apply its stored value to one input terminal of the comparator 210 and to the input of a reversible counter 213. The reversible counter 213 is also supplied with an output pulse signal $S_9$ produced by the pulse motor driving signal generator 211 to count the pulses of the signal $S_9$ corresponding to the actual position of the pulse motor 13. When supplied with the stored value from the reference position register 212, the counter 213 has its counted value replaced by the value of the reference position of the pulse motor.

The counted value thus renewed is applied to the other input terminal of the comparator 210. Since the comparator 210 has its other input terminal supplied with the same pulse motor reference position value, as noted above, no output signal is supplied from the comparator 210 to the pulse motor driving signal generator 211 to thereby hold the pulse motor at the reference position with certainty. Subsequently, when the $O_2$ sensor 28 remains deactivated, an atmospheric pressure-compensated preset value $PS_{CR}(P_A)$ is outputted from the arithmetic circuit 207 to the one input terminal of the comparator 210 which in turn supplies an output signal $S_{10}$ corresponding to the difference between the preset value $PS_{CR}(P_A)$ and a counted value supplied from the reversible counter 213, to the pulse motor driving signal generator 211, to thereby achieve accurate control of the position of the pulse motor 13. Also, when the other open loop control conditions are detected by the engine condition detecting circuit 205, similar operations to that just mentioned above are carried out.

Figure 3:
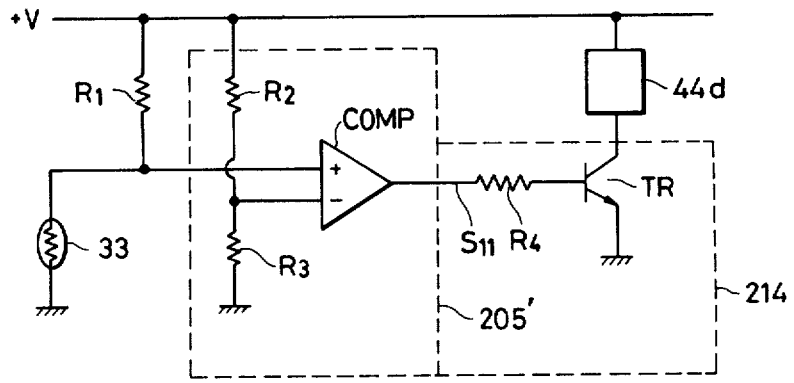
FIG. 3 is a circuit diagram illustrating an evaporated fuel purging control device provided within the electronic control unit in FIG. 1.

FIG. 3 illustrates an embodiment of a circuit which is provided within ECU 20 of FIG. 2 for controlling the temporary purge cut of fuel from the canister 40 to the venturi of the carburetor 3 which was previously set forth by reference to FIG. 1. Reference numeral 205' designates a comparator which forms part of the engine operating condition detecting circuit 205 in FIG. 2. The main body COMP of the comparator 205', which may be formed of an operational amplifier or the like, has its non-inverting input terminal connected to one end of the thermistor 33 in FIG. 1, which has its other end grounded. The above one end of the thermistor 33 is connected to a positive voltage power source by way of a resistance $R_1$. Connected to the inverting input terminal of the comparator main body COMP is the junction of a resistance $R_2$ with a resistance $R_3$, the resistances $R_2$, $R_3$ being serially connected between the positive voltage power source and the ground to provide at their junction a reference voltage. This reference voltage is set at a value corresponding to the predetermined temperature value Twp for comparison with the actual engine cooling water temperature Tw for determination of fulfilment of the condition of the temporary suspension of purging of vaporated fuel. The comparator main body COMP has its output terminal connected to the base of an NPN power transistor TR by way of a current limiting resistance $R_4$. The transistor TR forms a drive signal generator 214 which is connected to the solenoid **44*d* of the solenoid valve 44 appearing in FIG. 2. The transistor TR has its emitter grounded and its collector connected to one end of the solenoid 44*d*** which has its other end connected to the positive voltage power source.

Figure 4:
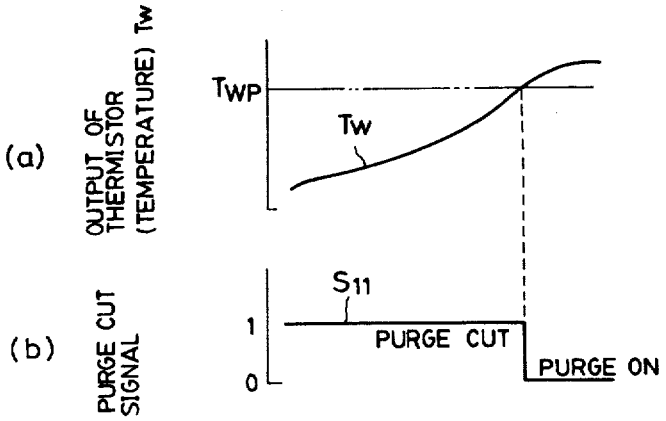
FIG. 4 is a graph showing the operation of the device of FIG. 3.

With the above arrangement, at the start of the engine, the engine cooling water temperature is low such that the thermistor 33, which has a negative temperature coefficient as previously noted, then has such a high internal resistance that the terminal voltage of the thermistor 33 which is applied to the non-inverting input terminal of the comparator main body COMP is higher than reference voltage at the junction of the resistance $R_2$ with the resistance $R_3$. As a consequence, the comparator main body COMP produces a binary output of 1 at its output terminal, which is applied to the transistor TR as a purge cut signal $S_{11}$ to cause it to conduct so that the solenoid 44 is in an energized state (FIG. 4). Due to this energization of the solenoid **44*d*, the valve body 44*b* of the solenoid valve 44 in FIG. 1 is biased against the force of the spring 44*c* to a position where it closes the control conduit 45 while simultaneously opening the air intake 44*a*. Thus, atmospheric air is introduced through the air intake 44*a* and the control conduit 46 into the pressure chamber 47*a* of the purge control valve 47 so that the diaphragm 47*b* is biased by the force of the spring 47*d* to a position where it closes an associated end of the fuel purging conduit 43 to keep absorbed fuel from being purged from the canister 40 to the primary venturi of the carburetor 3. Subsequently, when the engine cooling water temperature Tw rises above the predetermined value Twp as the warming-up operation of the engine proceeds so that the terminal voltage of the thermistor 33 drops below the aforementioned reference voltage, the comparator output goes to 0 to cause the transistor TR to turn off, which then deenergizes the solenoid 44*d* (FIG. 4). Consequently, the valve body 44*b* of the solenoid valve 44 is returned to its original position by the force of the spring 44*c* to close the air intake 44*a* and simultaneously open the conduit 45. Accordingly, negative pressure in the intake manifold 2 is introduced through the conduit 45 into the pressure chamber 47*a* of the purge control valve 47 to displace the diaphragm 47*b* against the force of the spring 47*d* into a position where it opens the associated end of the conduit 43. Thus, the fuel absorbed in the canister 40 is purged into the primary venturi of the carburetor 3**.

What is claimed is:

1. In an air/fuel ratio control system for performing feedback control of the air/fuel ratio of an air/fuel mixture being supplied to an internal combustion engine having an intake pipe, said system including means for detecting the concentration of an exhaust gas ingredient emitted from said engine, fuel quantity adjusting means for producing said mixture being supplied to said engine, and an electrical circuit operatively connecting said concentration detecting means with said fuel quantity adjusting means in a manner effecting feedback control operation to control the air/fuel ratio of said mixture to a predetermined value in response to an output signal produced by said concentration detecting means, the combination comprising: a canister having evaporated fuel absorbed therein; a purge conduit connecting said canister to said intake pipe of said engine for allowing said fuel absorbed in said canister to be purged into said intake pipe; a purge control valve having means actuatable by negative pressure and arranged across said purge conduit; a control circuit connecting said negative pressure-actuatable means of said purge control valve to said intake pipe; a solenoid valve arranged to selectively close and open said control conduit; means for driving said solenoid valve; a temperature sensor responsive to a change in the temperature of engine coolant to produce an output continuously variable with said change; and circuit means provided within said electrical circuit and operable to detect an operating condition of said engine; said circuit means being connected to said temperature sensor to be supplied with said output of said temperature sensor; said electrical circuit being operable to carry out control of the air/fuel ratio of said mixture in response to said output of said temperature sensor supplied to said circuit means; said circuit means being connected to said solenoid valve driving means and adapted to supply a control signal thereto when said output of said temperature sensor exceeds a predetermined value; said solenoid valve driving means being operable upon said control signal to actuate said solenoid valve to cause said negative pressure-actuatable means of said purge control valve to communicate with atmospheric air.

2. The air/fuel ratio control system as claimed in claim 1, wherein said circuit means includes a comparator arranged to compare said output of said temperature sensor with a predetermined reference voltage corresponding to said predetermined value and adapted to produce said control signal when the former exceeds the latter, and said solenoid valve driving means includes a power transistor arranged to be energized by said control signal to energize said solenoid valve.

* * * * *